US005181569A

United States Patent [19]

McCoy et al.

[11] Patent Number: 5,181,569

[45] Date of Patent: Jan. 26, 1993

[54] PRESSURE OPERATED VALVE

[75] Inventors: Brian K. McCoy, Dubai, United Arab Emirates; Tommy L. Stambaugh, Celina, Tex.

[73] Assignee: Otis Engineering Corporation, Dallas, Tex.

[21] Appl. No.: 856,185

[22] Filed: Mar. 23, 1992

[51] Int. Cl.[5] ..... E21B 34/14

[52] U.S. Cl. ..... 166/317; 166/135; 166/194; 166/318; 166/319; 166/332

[58] Field of Search ..... 166/317, 318, 319, 133, 166/135, 194, 188, 238, 239, 332; 137/68.1

[56] References Cited

U.S. PATENT DOCUMENTS

| | | | |
|---|---|---|---|
| 2,928,469 | 3/1960 | Crowe | 166/135 X |
| 3,042,116 | 7/1962 | Sharp et al. | 166/179 |
| 3,216,504 | 11/1965 | Roark | 166/181 |
| 4,007,783 | 2/1977 | Amancharla | 166/135 |
| 4,018,284 | 4/1977 | Perkins | 166/318 X |
| 4,188,999 | 2/1980 | Amancharla | 166/133 |
| 4,220,206 | 9/1980 | VanWinkle | 166/318 |
| 4,292,988 | 10/1981 | Montgomery | 166/318 X |
| 4,360,063 | 11/1982 | Kilgore | 166/317 |
| 4,405,017 | 9/1983 | Allen et al. | 166/135 X |
| 4,718,488 | 1/1988 | Pringle et al. | 166/135 |

*Primary Examiner*—Hoang C. Dang
*Attorney, Agent, or Firm*—Roland O. Cox

[57] ABSTRACT

In the disclosed pressure operated valve, a sleeve valve controlling flow between outside and inside the valve is releasably connected in a housing when the sleeve valve is in open position. Pressure on a ball sealingly engaging the sleeve valve operates the sleeve valve from open to latched closed to disconnect positions and expends the sleeve valve from the housing.

7 Claims, 2 Drawing Sheets

PRESSURE OPERATED VALVE

BACKGROUND OF THE INVENTION

1. Technical Field

This invention relates to pressure operated valves used in earth wells. More particularly, the present invention is a sleeve type valve releasably connected in a housing, which is operated by pressure to close and be expended from the housing.

2. Background Information

A sealing plug is usually installed in a pressure operated packer or well tubing to close the packer or tubing and permit pressurization of tubing connected to the packer to set the packer in casing in an earth well. An example of one such device is shown by U.S. Pat. No. 3,042,116 to Sharp et al. This patent discloses use of an adapter to connect an expendable sealing plug in a well packer and releasable latching means for holding the expendable sealing plug in the adapter. When connected in the packer, the plug closes the packer to through flow and there is no flow passage through the plug. The packer is lowered to setting depth with the plug connected in the packer and the plug is expended by application of tubing weight after use.

When lowering a packer with a sealing plug installed, all liquid displaced by lowering the packer and tubing into the well flows from below to above the packer through the small annular space between the packer and casing in the well. Usually, the packer and tubing are lowered rapidly into the well casing causing displaced liquid volume to be great, resulting in high liquid velocities through the small annular space. As most of the displaced liquids contain solid particles, the elastomeric sealing element on the packer may be abraded away or damaged by high velocity particles so that it will not seal in the well casing properly when the packer is operated to set.

Another example of a similar plug is shown in U.S. Pat. No. 3,216,504, "Plug for Well Conductors" to Roark. This plug is releasably lockable in a well packer having a latch head and is installed in the packer set in casing by lowering on a setting tool on tubing. This plug may be retrieved on tubing using the same setting tool or expended from the packer by application of tubing weight.

Running tubing from surface into a well to install or expend a sealing plug from a packer is a time consuming and expensive operation, especially if long lengths of tubing must be run to reach a packer set deep in a well.

SUMMARY OF THE INVENTION

The valve of the present invention includes a housing connectible on the lower end of a hydraulic set packer and has an expendable sleeve valve releasably locked in the housing. The valve is placed in open position when connected to the packer to provide additional flow area for and reduce velocity of displaced fluids flowing around the packer as the packer is lowered into the casing. On arrival of the packer at setting depth, a ball is dropped from surface which seals in the pressure operated valve and permits pressure to be applied in the packer to set the packer and move the pressure operated valve to closed position. An even greater pressure applied in the packer will disconnect and expend the sleeve valve from the housing.

Use of the invention pressure operated valve will permit a hydraulic set packer to be run, set and tested for sealing in well casing in one tubing trip and the pressure operated valve expended leaving the packer completely open for flow or passage of tools. Additional costly trips with tubing are not required to retrieve or expend the invention plug.

An object of this invention is to provide a pressure operated valve which provides a flow passage between outside and inside the valve when in open position.

Another object of this invention is to provide a pressure operated valve which may be operated to close by applying pressure on a ball sealingly engaging the valve.

Another object of this invention is to provide a pressure operated valve which when operated to close automatically latches in closed position.

Also an object of this invention is to provide a pressure operated valve having a housing in which a sleeve type valve is connected and the sleeve type valve may be disconnected and expended from the housing on application of pressure on a ball sealingly engaging the sleeve valve.

BRIEF DESCRIPTION OF THE DRAWINGS

FIG. 1 shows the valve 10 of this invention which includes a housing 11 in which the expendable sleeve valve 12 is releasably connected. The housing includes an appropriate connection 11*a*, a seal bore 11*b*, an internal groove 11*c* and a longitudinal flow passage 11*d*.

Figure 1:
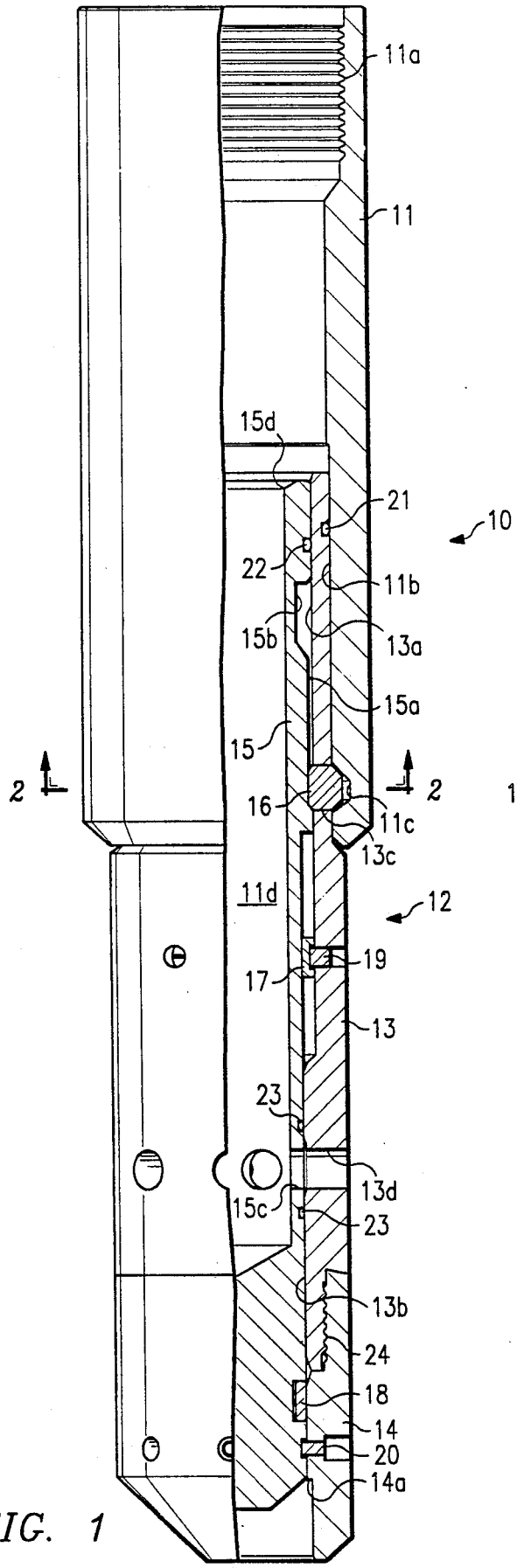
FIG. 1 is a sectioned drawing in elevation showing the valve of this invention connected in the housing in open position.

Expendable sleeve valve 12 includes a body 13, a lower body 14, a sleeve 15 with its lower end closed, lugs 16, a ring 17 and a latch ring 18. Shearable screws 19 releasably position ring 17 in body 13 and shearable screw 20 releasably position sleeve 15 in body 13. Resilient seal 21 on body 13 sealingly engages housing seal bore 11*b* and provides a static and sliding seal between the body and housing. Likewise, resilient seal 22 on sleeve 15 provides a static and sliding seal between body seal bore 13*a* and the sleeve and resilient seals 23 provide static and sliding seal with body seal bore 13*b*.

Figure 2:
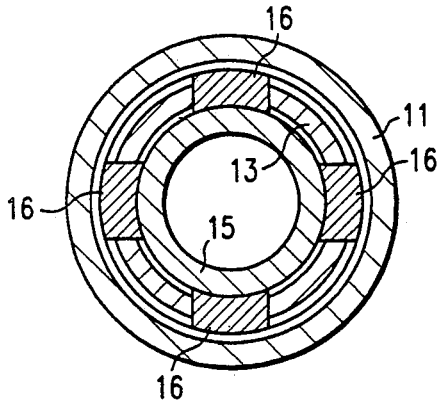
FIG. 2 is a cross sectional drawing along lines 2—2 of FIG. 1.

Lugs 16 are mounted for radial movement in body openings 13*c* (see also FIG. 2) and the body has a number of flow passages 13*d*. Lower body 14 is connected to body 13 at 24.

Sleeve 15 has a large diameter 15*a* for moving lugs 16 into engagement in groove 11*c* to connect body 13 to housing 11. The sleeve also has a number of flow passages 15*c* and a sealing surface 15*d*. The lugs may be moved in to contact the smaller diameter in groove 15*b* around the sleeve, when this groove is inside the lugs to disengage housing groove 11*c* and disconnect the body from the housing.

Figure 3:
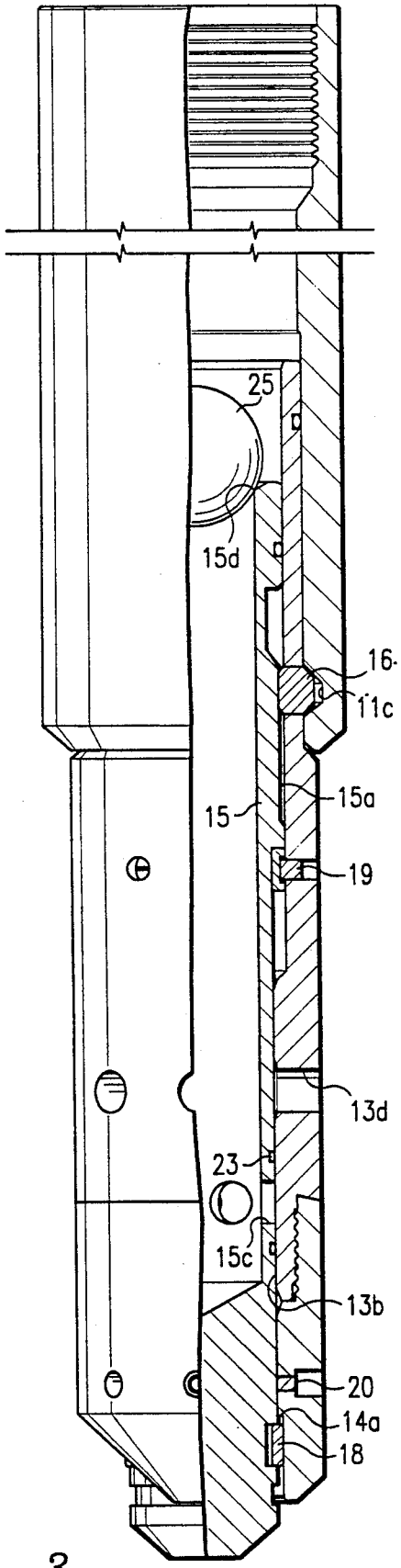
FIG. 3 is a drawing similar to FIG. 1 showing a ball sealingly engaging the valve of the present invention and the valve in closed and latched position.

The valve of this invention may be utilized to facilitate the installation of a hydraulic set packer in well casing by sealably connecting to the lower end of the packer on surface with the valve in open position with flow passages 15*c* aligned with passages 13*d* as shown in FIG. 1. As the packer is lowered into the well casing, displaced fluid flows from below to above the packer through the packer-casing annulus and from outside to inside the valve through passages 13*d* and 15*c*. The open valve also permits circulation between inside and outside the packer at any desired time. When the packer reaches desired setting depth, a ball 25 is dropped or pumped down from surface to sealingly engage surface 15*d* on the valve sleeve and prevent flow from inside to outside the packer. Required pressure is now applied to fluid in the packer to set the packer. Predetermined pressure greater than packer setting pressure will shear screws 20 and move sleeve 15 downwardly to the position shown in FIG. 3. Body openings 13*d* are closed to flow between outside and inside the valve as sleeve flow passages 15*c* and upper seal 23 have been moved below openings 13*d*. Latch ring 18 has sprung out under lower body shoulder 14*a* latching the sleeve in closed position. Larger diameter 15*a* retains lugs 16 engaged in housing groove 11*c* and body 13 connected in housing 11.

Figure 4:
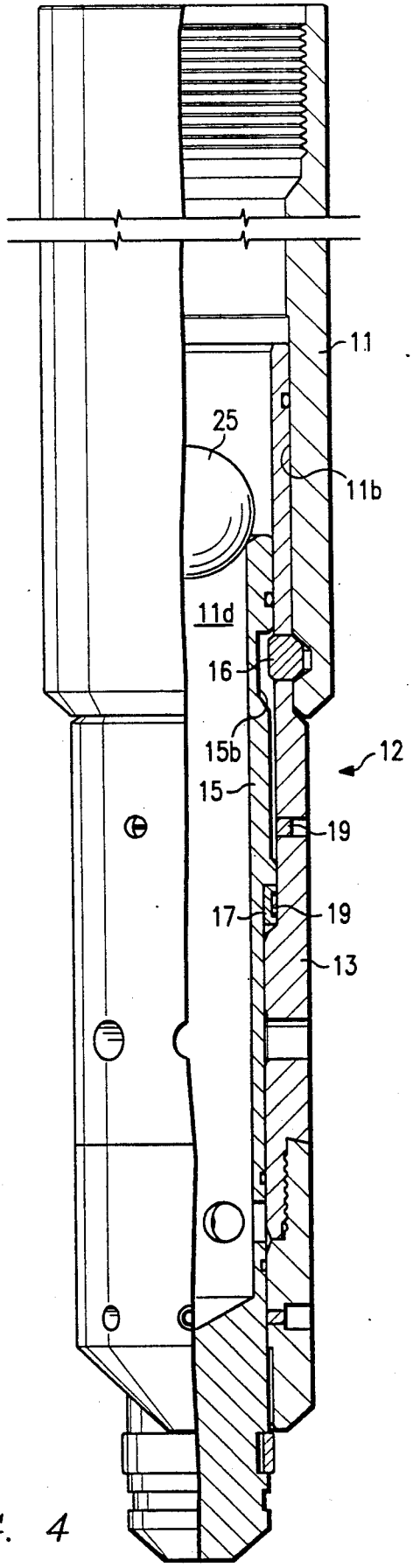
FIG. 4 is a drawing similar to FIG. 3 showing the invention valve disconnected from the housing just prior to being expended.

Another increase in pressure to a greater predetermined pressure will shear screws 19 and move sleeve 15 further downwardly as shown in FIG. 4. Ring 17 has stopped downward movement of the sleeve with smaller groove diameter 15*b* inside lugs 16. Sustained pressure on ball 25 will now move sleeve 15 and body 13 downwardly, camming lugs 16 inwardly to disconnect body 13 from housing 11 and move valve 12 downwardly from housing bore 11*b* expending the valve downwardly into the well from housing 11. Housing flow passage 11*d* is now completely open for two way flow and passage of well tools.

What we claim is:

1. A pressure operated valve comprising:

(a) a cylindrical housing;

(b) sleeve valve means for controlling flow between outside and inside said housing; said sleeve valve means releasably connected in said housing, said sleeve valve means including a valve sleeve having a sealing surface therein, said valve sleeve moveable downwardly from an open position, permitting flow between the outside and inside said housing to closed position, preventing flow between outside and inside said housing, said valve sleeve further moveable to a released position disconnecting said sleeve valve means from said housing;

(c) means for releasably connecting said sleeve valve means in said housing; and (d) a ball for sealingly engaging said valve sleeve sealing surface and moving said sleeve from said open to closed to released position and expending said sleeve valve means from said housing.

2. A valve according to claim 1 wherein the sleeve valve means comprises:

(a) a cylindrical body, said body having
- a seal thereon for sealingly engaging the cylindrical housing,
- openings and
- flow passages through said body wall, (b) the valve sleeve slidably mounted in said body and further including,
- a seal thereon for sealingly engaging said body,
- flow passages through said valve sleeve wall, said valve sleeve releasably positioned in said open position in said body with said valve sleeve flow passages aligned with said body flow passages,
- a seal above, and
- a seal below said valve sleeve flow passages;

(c) means releasably positioning said valve sleeve in said body;

(d) a ring around said valve sleeve releasably positioned in said body;

(e) means releasably positioning said ring in said body; and (f) means for latching said sleeve in said closed position.

3. A pressure operated valve according to claim 1 wherein the means releasably positioning the valve sleeve in the body is a shearable screw through the body wall near the lower end of the valve sleeve.

4. A pressure operated valve according to claim 2 wherein the means releasably positioning the ring in the body comprises:

(a) a groove in said ring; and (b) shearable screws through the body wall into said groove.

5. A pressure operated valve according to claim 2 wherein the means for latching the valve sleeve in said closed position comprises:

(a) a groove around said valve sleeve below the flow passages;

(b) a spring ring contracted into said ring groove; and (c) a shoulder in the body.

6. A pressure operated valve according to claim 2 wherein the means for releasably connecting the sleeve valve means in the housing comprises:

(a) an internal groove in said housing;

(b) laterally moveable lugs mounted in the body openings;

(c) a larger diameter surface on the valve sleeve for moving said lugs into engagement in said internal housing groove connecting the body to said housing when said valve sleeve is in said open position; and (d) a smaller diameter groove around said valve sleeve into which said lugs may be moved to disengage said internal housing groove when said valve sleeve is in said released position.

7. A pressure operated valve comprising:

(a) a cylindrical housing having a groove therein;

(b) sleeve valve means for controlling flow between outside and inside said housing releasably connected in said housing, said sleeve valve means including:
- a cylindrical body having seals thereon for sealingly engaging said housing,
- openings through said body wall,
- lugs mounted for lateral movement in said openings,
- flow passages through said body wall, and
- a lower internal shoulder therein,
- a valve sleeve slidably mounted in said body,
- a ring releasably positioned in said body around said valve sleeve,
- said sleeve valve having a sealing surface therein,
- a seal thereon for sealingly engaging said body,
- smaller and larger diameter surfaces thereon,
- flow passages through said valve sleeve wall,
- a seal above and a seal below said flow passages,
- a latch ring contracted into said lower groove,
- said valve sleeve releasably positioned in an open position in said body where said body flow passages and said valve sleeve flow passages are aligned permitting flow between outside and inside said housing and said valve sleeve larger diameter surface holds said lugs engaged in said housing internal groove, connecting said body to said housing, said valve sleeve moveable downwardly to a closed position, preventing flow between outside and inside said housing by applying pressure in said housing on a ball sealingly engaging the sealing surface in said valve sleeve, where said latch ring has sprung out under said lower body shoulder latching the valve sleeve in said closed position, said valve sleeve further moveable by application of greater pressure in said housing to move said smaller diameter surface inside said lugs permitting said lugs to disengage said housing internal groove disconnecting said sleeve valve means body from said housing and expending said sleeve valve means from said housing.

* * * * *